United States Patent [19]

Norton

[11] 4,083,299

[45] Apr. 11, 1978

[54] ELECTROMAGNETIC STRIKING MEMBERS SELECTIVELY ACTUATED IN TIME FROM ALTERNATING CURRENT POWER

[75] Inventor: Donald C. Norton, Costa Mesa, Calif.

[73] Assignee: C. Itoh Electronics, Inc., Los Angeles, Calif.

[21] Appl. No.: 761,585

[22] Filed: Jan. 24, 1977

[51] Int. Cl.[2] ..... B41J 3/04

[52] U.S. Cl. ..... 101/93.03; 101/93.05; 101/93.14; 101/93.29; 197/1 R

[58] Field of Search ..... 197/1 R; 101/93.03, 101/93.09, 93.05, 93.14, 93.13, 93.15, 93.28–93.34, 110; 317/123–128

[56] References Cited

U.S. PATENT DOCUMENTS

| | | | |
|---|---|---|---|
| 3,443,514 | 5/1969 | Schwartz | 101/93.14 |
| 3,731,622 | 5/1973 | Baranoff | 101/110 X |
| 3,866,533 | 2/1975 | Gilbert et al. | 101/93.03 X |
| 4,027,761 | 6/1977 | Quaif | 197/1 R |

*Primary Examiner*—Ralph T. Rader
*Attorney, Agent, or Firm*—Raymond L. Madsen

[57] ABSTRACT

There is disclosed an impact device for operation from a source of alternating power and with at least striking member adapted to be electromagnetically actuated to impact against an opposing surface. An electrical gate under the control of a switching circuit and at a given point in time and for a given time duration connects a source of alternating power to the electromagnetic striking member. A source of gate control pulses for rendering the electrical gate conductive and non-conductive is connected through the switching circuit under the direction of a switch control circuit to the electrical gate for selecting which of the gate control pulses are to be connected to the electrical gate. The source of gate control pulses generates a time sequence of pulses of a given time duration in synchronism with the source of alternating power and a phase shift circuit shifts the time relationship between the pulses and the waveform of the alternating power to control the point of activation of the striking member and thereby adjust the impact force of the striking member against the opposing surface.

An electrical system is also disclosed for generating several or more sources of alternating power shifted in phase relative to one another to which a striking member may be selectively connected for increasing the number of times the striking member may be actuated during the time interval of one cycle of the source of alternating power.

11 Claims, 7 Drawing Figures

ELECTROMAGNETIC STRIKING MEMBERS SELECTIVELY ACTUATED IN TIME FROM ALTERNATING CURRENT POWER

The present invention relates to electromagnetic actuated striking members and more particularly to impact printers and to print hammer timing and energizing means of high speed printers and electrical print impression control from sources of alternating power.

Impact printers can be divided into serial printers using a dot format or a shaped character format and line printers which form a line by the successive printing of sets of characters. Shaped character printing is accomplished either by the front striking method, where the paper is impacted with the character itself as in a typewriter, or by impacting the character placed behind the paper with a hammer mechanism. The latter method is common to most medium and high speed printers. In dot matrix printers, characters are formed by a matrix configuration or character set where the dots are printed by print needle actuators controlled by a read only memory.

In the field of high speed impact printers, it has been the general practice to employ DC power supplies from which power is derived to operate the printing hammers. As disclosed in Gilbert, et al., U.S. Pat. No. 3,866,533, impression control for an impact printer may be provided by changing the width of the direct current (DC) pulse applied to the print hammers in accordance with the thickness of the forms on which printing is being performed and in accordance with the magnitude of the voltage of the DC source energizing the print hammers, so as to maintain an impact force to provide uniform print density for different forms of thicknesses and variations in voltage. Misregistration of characters caused by a variation in the rate of movement of the print hammer relative to the printing surface may be compensated for by changing the start time of the DC pulse energizing the hammer. Although such techniques have served the purpose, they have not proved entirely satisfactory under all conditions of service for reasons that considerable difficulty has been experienced in lowering the cost of a printer which requires a DC power supply.

Those concerned with the development of impact printers have long recognized the need for eliminating DC power supplies while maintaining the ability to adjust the striking force and the time of actuation of the printing hammer. The present invention fulfills this need.

U.S. Pat. No. 3,731,622, issued to Baranoff discloses electromagnetically actuated hammers which are operated from an alternating current (AC) signal such as 110 volts/60 Hertz. However, there is no provision for controlling the striking force of the impact or printing hammer. Also, once the silicon controlled rectifiers, used as gates to connect the AC source to the electromagnetically actuated hammer, are activated they remain conductive until the AC waveform reverses polarity thereby giving no control for the point in time when the print hammer is released from the impact surface.

Similarly, in U.S. Pat. No. 3,443,514 granted to H. S. Schwartz, is disclosed print hammer timing and energizing means in high speed printers where the hammer is driven from an alternating power source in synchronism with a print drum. However, there is no adjustment for the striking force or time release of the printing hammer. A motor-generator set is used to generate the source of AC and has an alternating frequency greater than 60 Hz to obtain the desired printing speed.

One of the most critical problems confronting designers of high speed impact devices has been the operation of the impact members from a source of AC power at a given point in time and for a given time duration and with a variable striking force. This problem is overcome by the present invention.

In the field of impact printers there has been a need for impact printers that can be adjusted to print through variable thicknesses of printing material or paper, as well as to print the magnetic characters used in the magnetic character recognition systems. The present invention fulfills this need.

The general purpose of this invention is to provide an impact or striking member which embraces all the advantages of similarly employed impact devices and possess none of the aforedescribed disadvantages. To obtain this the present invention comtemplates a unique circuit arrangement for the synchronized generation of pulses of given time duration at given points in time with respect to an alternating source of power to operate gates to selectively connect electromagnetic actuated impact members to the source of alternating power and for providing sources of alternating power shifted in phase with respect to one another whereby the printing members may be operated from the alternating source of power at specific points on the waveform of the alternating source of power to control the force of impact and whereby a set of electromagnetically actuated striking members, such as a dot matrix printer can be operated at a frequency substantially greater than the frequency of the alternating source of power.

An object of the present invention is the provision of electromagnetic actuation of impact members for given time durations from a source of alternating power at given points in time on the waveform of the source of alternating power.

A further object of the present invention is the provision of operation of electromagnetically actuated impact members from a source of alternating power at variable points on the waveform of the source of alternating power to obtain variable striking forces.

Another object is to inhibit the operation of electromagnetically actuated impact members from a source of alternating voltage when the point of operation on the waveform of the source of alternating power drops below a given level.

A still further object of the invention is the provision for the actuation of a set of electromagnetically actuated impact members from an alternating power source at a frequency substantially greater than the frequency of the alternating power source.

Other objects and many of the attendant advantages of this invention will be readily appreciated as the same becomes better understood by reference to the following detailed description, when considered in connection with the accompanying drawings in which like reference numerals designate like parts throughout the figures thereof and wherein.

Figure 1:
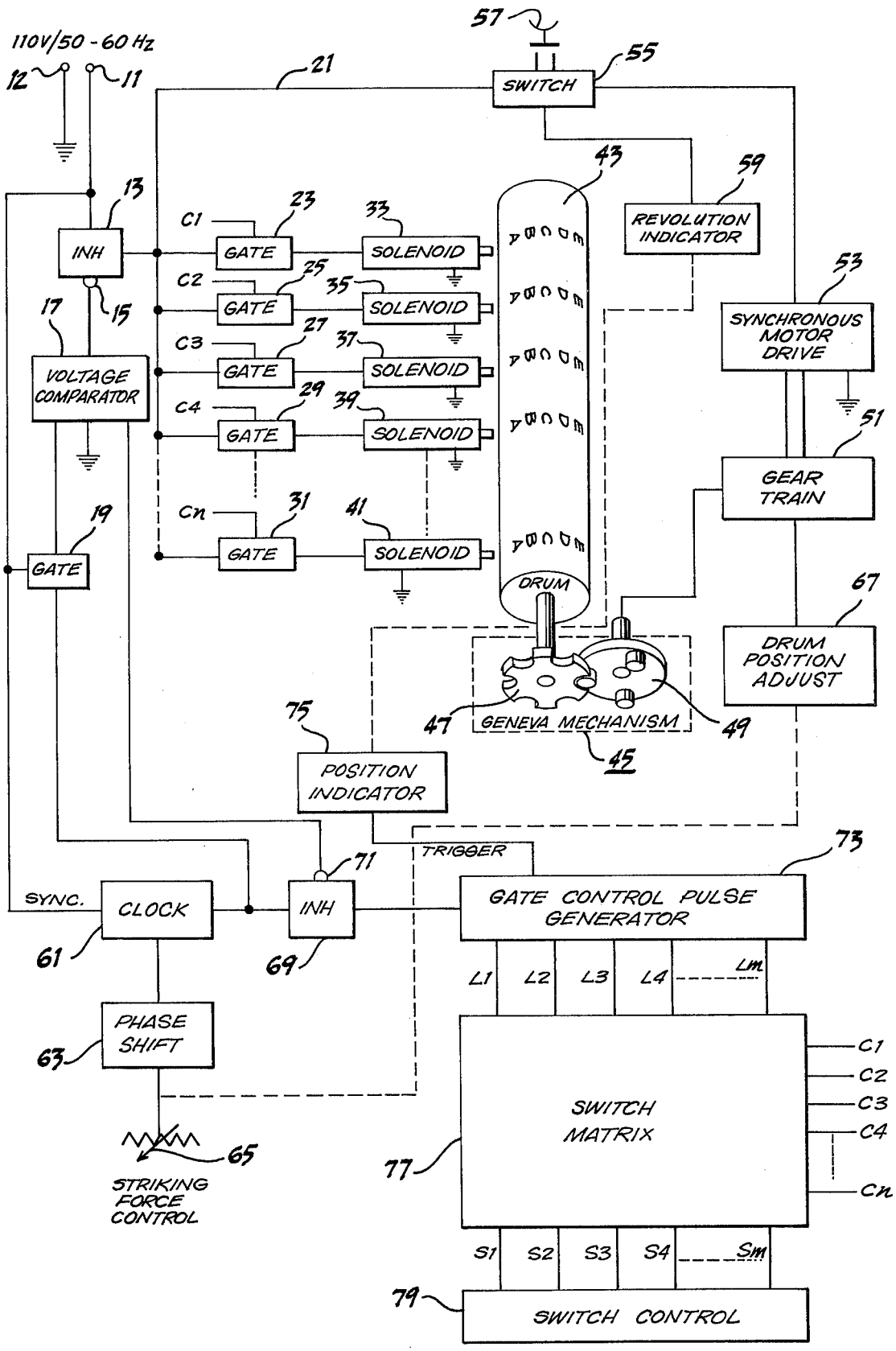
FIG. 1 shows a block diagram of a preferred embodiment of the invention.

Referring now to the drawings wherein like reference characters designate like or corresponding parts throughout the several views, there is shown in FIG. 1 (which illustrates a preferred embodiment) a pair of impact power terminals 11 and 12 which are adapted to be connected to a source of alternating power such as 110 volts/50 or 60Hertz. Terminal 11 is connected to the input of voltage comparator 17 which in turn has an input connected through a sampling gate 19 to terminal 11. The output of inhibiting gate 13 is connected to a distribution buss 21 to which the input to a plurality of electrical gates 23, 25, 27, 29 and 31 are connected, (a dashed line between gates 29 and 31 indicate that any number of additional electrical gates may be inserted therebetween as desired). The outputs of gates 23 through 31 are each respectively connected exclusively to one of the solenoid actuated striking or impact members 33, 35, 37, 39 and 41. Each of gates 23 through 31 has a gate control electrode designated as C1, C2, C3, C4, and C*n*, respectively, (a dashed line between solenoid actuated impact member 39 and solenoid actuated impact member 41 indicates that any number of solenoid actuated impact members may be inserted therebetween, corresponding to the number of electrical gates).

A rotating drum, impact or opposing surface 43 is juxtaposed the plurality of solenoid actuated impact members 33 through 41. A geneva mechanism 45 (within the rectangular dashed lines) is connected to a shaft on drum 43, which geneva mechanism has a slotted wheel 47 engaged by a crank wheel 49 which in turn is connected to a gear train system 51 which further is connected to the shaft of a synchronous motor drive 53. Synchronous motor drive 53 in turn is connected through a control switch 55 to distribution buss 21. Switch 55 has pushbutton actuator 57 thereon and is further connected to a revolution indicator 59 which in turn is connected to the rotating shaft of drum 43 (indicated by the dashed line).

Line 11 of the pair of input power terminals is connected through a sync line to a clock 61 which generates pulses in synchronism with the alternating power source waveform. Clock 61 has a phase shift circuit 63 connected thereto and a striking force adjustment control 65 connected to phase shift circuit 63. Striking force control 65 is further mechanically coupled to drum position adjust 67 (indicated by the dashed line) which in turn is mechanically connected to gear train 51. The pulse output of clock 61 is connected to the control electrode of a gate 19 and is further connected to the input of an inhibit gate 69. The inhibit electrode 71 of inhibit gate 69 is connected to a voltage comparator 17. The output of gate 69 is connected to a gate control pulse generator 73.

Gate control pulse generator 73 has a trigger line connected between it and position indicator 75 which in turn is mechanically connected to the rotating shaft of drum 43. Gate control pulse generator 73 has a plurality of pulse output lines L1, L2, L3, L4, and L*m* connected to switch matrix 77. Switch matrix 77 has a switch control or pulse program control 79 connected thereto through lines S1, S2, S3, S4, and S*m*. Switch matrix 77 has output pulse lines C1, C2, C3, C4, and C*n* which in turn are connected to the gate control electrodes of gates 23 through 31. Dashed lines are indicated between line L4 and L*m*, line C4 and C*n* and lines S4 and S*m* to indicate any desired number of lines may be inserted therebetween depending upon the number of solenoid actuated impact members and the number of impact positions utilized on drum 43.

Figure 2:
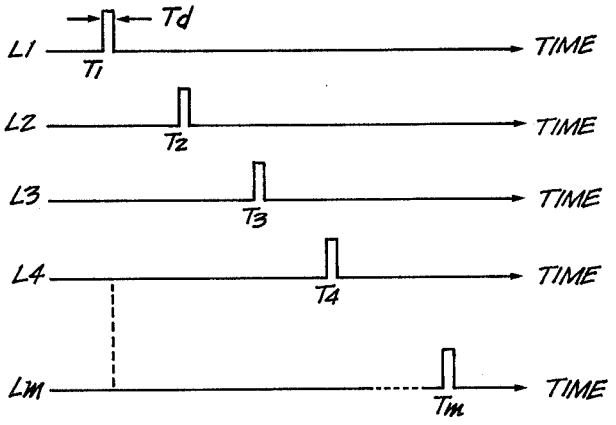
FIG. 2 illustrates the time duration and sequence of gate control pulses of the apparatus shown in FIG. 1.

FIG. 2 shows the time sequence of gate control pulses produced by gate control pulse generator 73 in FIG. 1. Line L1 of gate control pulse generator 73 generates a pulse at T1 for a time duration of T*d*. Line L2 produces a pulse at the same time duration at a time T2 synchronized in time with the waveform the alternating source of power. Similarly line L3 produces a pulse at time T3 of the same time duration as the pulses on line L1 and L2 and similarly for line L4 which produces a pulse at time T4, and so on to line L*m* which produces a pulse at time T*m*.

Although not illustrated in FIG. 2., the time between the occurrence of each of the pulses on lines L1 through L*m* may be chosen to coincide in time with the 45°, 135°, 225° and 350° phase angle position or points on the alternating power waveform or one half that rate by spacing the pulses 180° apart in time with respect to the waveform of the alternating power or, again, one half that rate by spacing the pulses apart in time equivalent to 360° of the waveform of the alternating power. It should be noted that after the complete sequence of pulses has been generated on lines L1 through L*m*, then the sequence begins over again starting with a new pulse on line L1 and continuing from line to line in the same time relationship as before to the last pulse generated on line L*m*. Although a parallel output of pulse lines is illustrated, it is also contemplated to use a serial output by appropriate circuit changes well known to the electronic designer.

Figure 3:
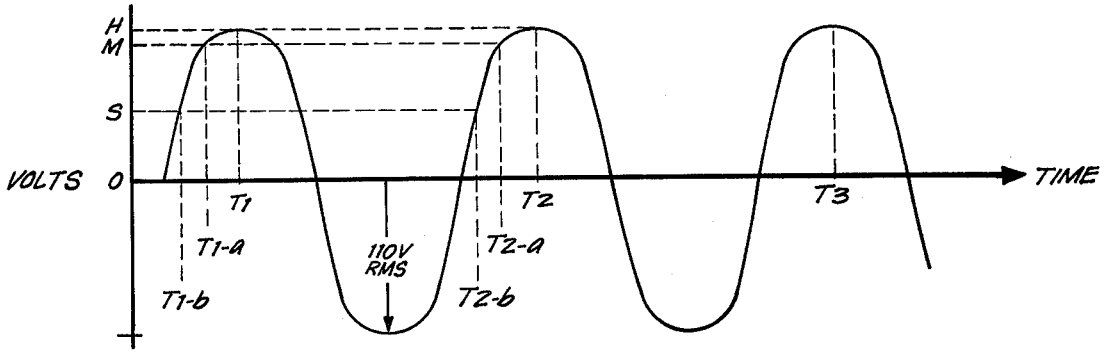
FIG. 3 illustrates the time sequence of the pulses illustrated in FIG. 2 with respect to the voltage waveform of a source of alternating power.

In FIG. 3 there is illustrated the relation to the alternating power waveform of the gate control pulses from gate control pulse generator 73. The time spacing between pulses is equivalent to 360° of the phase of alternating waveform or approximately 16.67 milliseconds if the alternating waveform is 60 Hertz. The occurrence of the times T1, T2, and T3 are synchronized in respect to the alternating power waveform to coincide with the maximum point of each positive half cycle of the power waveform. If the waveform is a voltage waveform, this is the point of maximum voltage on the positive half cycle of the waveform and therefore imparts the strongest or most hard striking force to the impact members when actuated at that point in time. This level of voltage is designated as "H" in FIG. 3 to indicate "hard" striking force. If the operation time is advanced by a time "*a*", pulse T1 will occur at time (T1-*a*) and therefore at a point of lower voltage on the voltage waveform indicated by "M" which represents a "medium" striking force. If the time is advanced even further by an amount "*b*" such that pulses T1 and T2 now occur at (T1-*b*) and (T2-*b*) the occurrence is still further down on the voltage waveform of the alternating power as indicated by "S" designated for "soft" striking force. The adjustment of the point in time at which the pulses occur in respect to the alternating power waveform is controlled by phase shift circuit 63 and striking force control 65 thereof.

Figure 4:
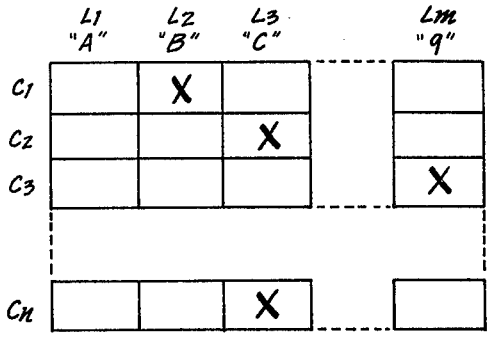
FIG. 4 illustrates a table of interconnections required through switches which are activated in the switch matrix in FIG. 1 in order to actuate a particular character printing sequence.

Turning now to FIG. 4, a table is presented which indicates what connections are made between gate control pulse generator lines L1 through L*m* and gate control lines C1 through C*n* in order to actuate selected impact members to produce a desired result. The particular table illustrated is for a condition when the rotation of drum 43 is synchronized such that an embossed character "A" thereon appears under the solenoid actuated impact members 33 through 41 at the time a gate control pulse is generated on line L1 and, similarly, that an embossed character "B" appears under the solenoid actuated impact members when a pulse appears on line L2 and an embossed character "C" is aligned under the solenoid actuated impact members when a pulse appears on line L3 and so on until we reach line L*m* where at time T*m*, the numeral "9" appears under the solenoid actuated impact members. Therefore, if the letter "B" is desired to be printed in the first column underneath solenoid actuated impact member 33 of FIG. 1, the switch matrix 77 must be controlled by switch control 79 to interconnect line L2 with gate control line C1 as indicated by the "X" in the first row and second column of the table. Similarly, to have the letter or character "C" printed under solenoid actuated member 35, line L3 must be connected to gate control line C2 as indicated by the "X" in the second row and third column of the table. To have the numeral "9" imprinted underneath solenoid actuated member 37, an "X" must appear in the table in the third row and the last column of the table. Finally, to imprint "C" under impact member 41, line L3 must be connected to gate control line C*n* and, therefore, an "X" appears in the bottom row and third column of the table. It should be noted that switch control circuit 9 may be a keyboard which controls switch matrix 77 to interconnect gate control pulse lines L1 through L*m* selectively to gate control lines C1 through C*n*.

Figure 5:
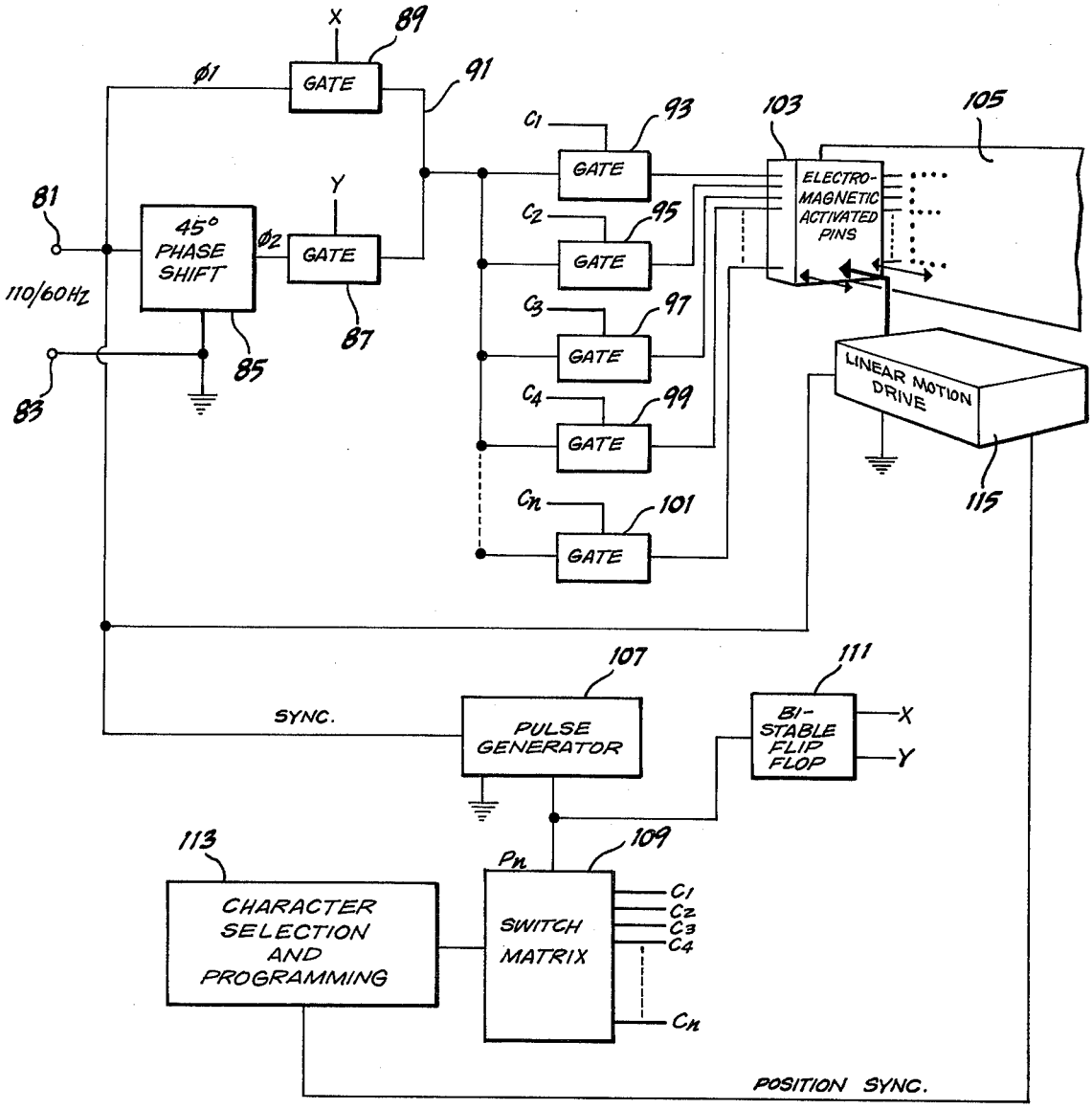
FIG. 5 illustrates a block diagram of a preferred embodiment of the invention applied to a serial dot matrix impact printer.

Turning now to FIG. 5, there is shown a dot matrix printing system having terminals 81 and 83 adapted to be connected to an alternating source of power such as 110 volts/60 Hertz, terminal 81 being further connected to a 45° phase shift circuit 85 which produces an alternating voltage waveform output $\phi 2$ which is connected to the input of a power gate 87 having a gate control electrode designated as "Y" thereon. Line 81 is further connected to the input of a power gate 89 having a gate control electrode designated as "X" thereon. The alternating voltage waveform on line 81 is designated as $\phi 1$. The output of power gates 87 and 89 are further connected to distribution buss 91 which in turn is connected to a plurality of electrical gates 93, 95, 97, 99 and 101, each gate having its output connected exclusively to one of a plurality of electromagnetically actuated pins 103 aligned in a vertical row, adjacent to a striking or opposing impact surface 105 so as to selectively imprint thereon a sequence of dots.

Line 81 is further connected by a sync line to a pulse generator 107 which generates at its output a series of pulses P*n* which in turn are connected to a switch matrix 109 and bi-stable flip-flop 111. Switch matrix 109 is programmed and controlled by character selection and programming circuit 113 connected thereto. Switch matrix 109 has output gate control lines C1, C2, C3, C4 and C*n* which are respectively connected to control electrodes of electrical gates 93, 95, 97, 99 and 101, the control electrodes being designated, correspondingly, as C1 through C*n*. Linear motion drive 115 is connected to the source of alternating power to linerly drive electromagnetically actuated pins 103 across impact or opposing surface 105. A position sync line from linear motion drive 115 is connected to character selection and programming circuit 113 to synchronize the operation of electromagnetically actuated pins 103 with a desired printing sequence established by character and selected programming circuit 113. Therefore, as electromagnetic pins 103 are moved over the opposing surface 105, gates 93 through 101 and power gates 89 and 87 are controlably and selectively actuated to produce a desired dot pattern across impact surface 105.

Figure 6:
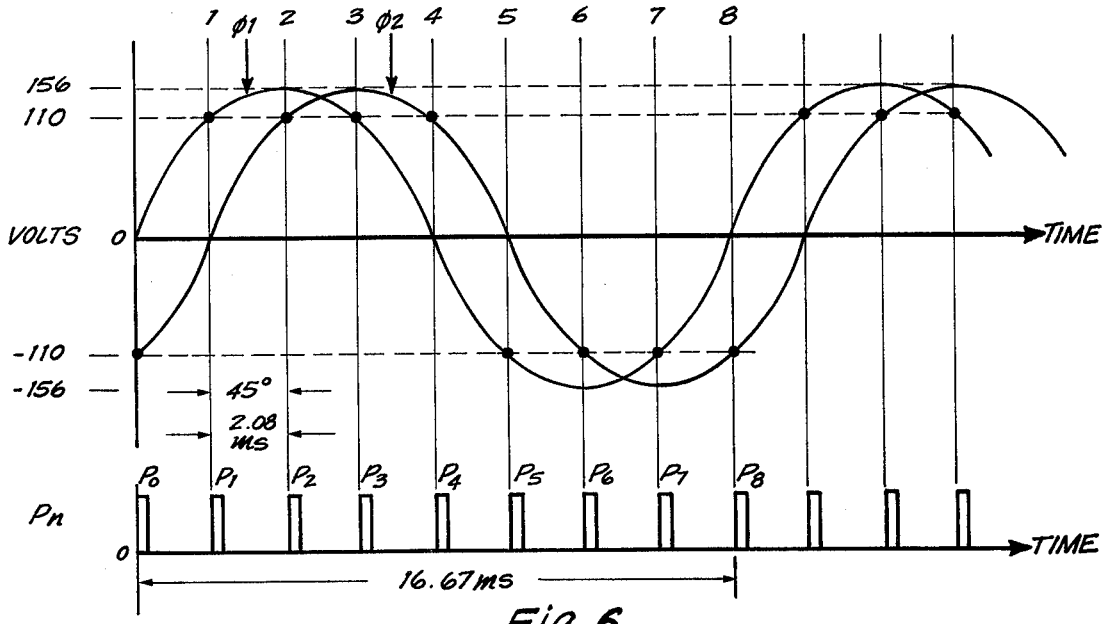
FIG. 6 shows the phase and time waveform relationship of the phase shifted sources of alternating power and the points on the waveform at which the printing members of FIG. 5 are actuated.

In FIG. 6 there is illustrated the phase relationship between waveform $\phi 2$, the output of the 45° phase shift circuit 85 and the alternating power waveform $\phi 1$. In addition, the synchronized pulse sequence of pulse generator 107 is illustrated in time relationship with respect to the alternating waveform $\phi$ and $\phi 2$. When the voltage of waveform $\phi 1$ is zero, the voltage waveform $\phi 2$, at the output of 45° phase shift circuit 85, is $-110$ volts. When the voltage waveform $\phi 1$ is $+110$ volts, the voltage waveform $\phi 2$ is zero, and so on. Therefore, if the alternating power voltage is 60 Hertz, pulses may be generated from pulse generator 107 approximately 2.08 milliseconds apart and synchronized to occur at the 45°, 135°, 225°, and 315° phase points, respectively, on waveform $\phi 1$ and waveform $\phi 1$ and $\phi 2$. Gates 93 through 101 may be selectively operated at these points in time on waveforms $\phi 1$ and $\phi 2$ to produce eight operations of electromagnetic actuated pins 103 during one cycle of the alternating power waveform. The pulse output of pulse generator 107 is indicated in FIG. 6 by pulses P0, P1, P2, P3, P4, P5, P6, P7, and P8 which pulses are for selective actuation of electromagnetic pins 103 sequentially eight times during the 16.67 milliseconds of the 60 Hertz alternating waveform.

Figure 7:
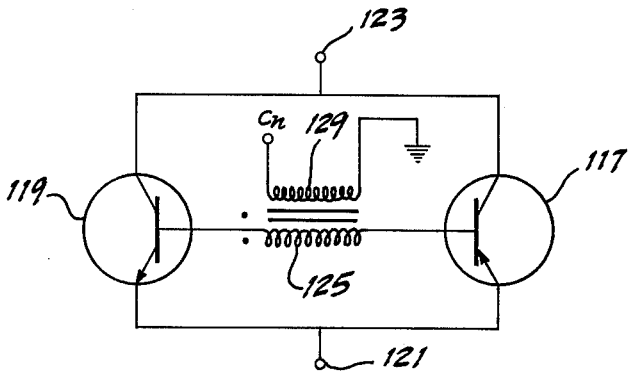
FIG. 7 shows a typical semiconductor gate which may be employed in the gate circuit of FIGS. 1 and 5.

FIG. 7 illustrates a typical electrical gate which may be utilized for gates 23 through 31, 93 through 101 and gates 89 and 87. A pnp power transistor 117 has its emitter connected to the emitter of an npn power transistor 119 to form one terminal 121 of the gate. The collector of transistor 117 is connected to the collector of transistor 119 to form the other terminal 123 of the gate. The bases of transistors 119 and 117 are connected together through a secondary winding 125 of a pulse transformer 127, a primary winding 129 thereof being connected to a gate control line designated as C*n* to receive gate control pulses for the operation thereof.

Operation of the preferred embodiment of the invention can best be described by reference to FIG. 1. Voltage comparator 17 may comprise a differential amplifier having one input connected to a predetermined reference voltage such as a string of series connected Zener diodes well known to electronic designers of voltage comparator circuits and another input connected through sampling gate 19 to line 11. Gate 19 is opened at the point in time on the input power waveform at which one or more of the solenoid actuated impact members 33 through 41 are connected through their respective gates to the source of alternating power to cause them to impact against opposing drum 43. If the voltage of the input power waveform at this point in time is below the reference voltage level as set in the voltage comparator, an output is generated from the voltage comparator to inhibit electrode 15 of inhibit gate 13 to prevent the connection of the input power waveform to distribution buss 21, and the operation of the respective impact members 33 through 41. In addition, since buss 21 also is connected to synchronous motor drive 53 through switch 55, synchronous motor 53 is also stopped and the rotary motion of drum 43 is inhibited. Similarly, the voltage comparator generates an inhibit signal to inhibit electrode 71 of inhibit gate 69 and prevents the pulses from clock 61 from entering gate control pulse generator 73 and, therefore, inhibits the output of gate pulses on line L1 through L*m* of gate control pulse generator 73. The entire system is inhibited from operation, and waits until the next point in time on the input power waveform at which to try again to see if the previous impact operation which was inhibited can be carried out. If the line voltage at this next point in time is greater than the reference voltage, then the operation will not be inhibited and a selected set of solenoid actuated impact members will be impacted against drum 43 at a particular location thereon.

When input line voltage is sufficiently greater than the voltage reference of voltage comparator 17, the system may be started by depressing button 57 and switch 55 to start synchronous motor drive 53 turning gear train 51 which in turn operates geneva mechanism 45 to rotate drum 43 in an intermittent rotary stepping motion, the pins of crank wheel 49 sequentially engaging the slots of the slot wheel 47 to accomplish such intermittent motion. Drum 43 is rotated thereby to sequentially locate and stop each row of a group of embossed characters on drum 43 adjacent the row of solenoid actuated impact members 33 through 41 while selected impact members are actuated to strike the particular row of characters. Position indicator 75 indicates the position of the drum 43 so that the row of characters aligned and stopped underneath the row of solenoid actuated members is synchronized with the generation of gate control pulses from generator 73 and the actuation of selected solenoid actuated members.

The characters to be impacted or printed on material which may be inserted between the surface of drum 43 and the solenoid actuated impact members are controlled by switch control 79 which selects and controls which gate control pulse line is to be connected to what gate control lines to operate the respective solenoid actuated impact members by connecting them through the electrical gates to specific points in time on the alternating power waveform.

In order to control the points and time at which the solenoid actuated impact members are to be operated from the alternating power waveform, clock 61 generates a series of pulses synchronized in time with the alternating waveform of the input power. Phase shift circuit 63 is adjusted by striking force control 65 to vary the phase relationship or time position of this synchronized string of pulses with respect to the alternating waveform of the input power. The pulses from clock 61 are gated into gate control pulse generator 73 which generates a time sequence of pulses in parallel output on lines L1 through L*m*. Under the direction of switch control 79, switch matrix 77 connects the appropriate gate control pulse on lines L1 through L*m* to the desired electrical gate control line C1 through C*n* of electrical gates 23 through 31. The desired gate is opened and connects the solenoid impact member associated therewith to the input power line to actuate the impact member to strike drum 43 at a desired location thereon. Geneva mechanism 45 operates to hold drum 43 stationary for the duration of the gate control pulse which corresponds to the time a solenoid impact member is impacted against the opposing surface of drum 43 to prevent smearing of the character printed by the impact.

In order to maintain alignment of the characters on drum 43 correctly adjacent or juxtaposed the desired solenoid actuated members when the phase of the gate control pulses is shifted in respect to the input power line waveform, striking force control 65 is mechanically coupled to drum position adjust 67 to position the gears of gear train 51 and the components of geneva mechanism 45 so that the points in time that drum 43 is stationary or not moving coincide with the points in time the gate control pulses occur to operate the solenoid actuated impact members. Consequently, regardless of the phase shift variation produced by the striking force control 65, drum 43 is always mechanically aligned and synchronized with the time operation of the solenoid actuated impact members.

To provide a one-cycle or one-revolution operation of drum 43, revolution indicator 59 opens up switch 55 at the end of each revolution to stop the further rotation of drum 43. To start subsequent cycles, button 57 is depressed to latch switch 55 and activate synchronous motor drive 53 to turn drum 43 in its stepping rotary motion until revolution indicator 59 unlatches and opens switch 55.

It should be noted in FIG. 2 that the gate control pulses generated by gate control pulse generator 73 have a short time duration "T*d*" which is substantially less in time than one-half the time of one cycle of the input power alternating waveform. By employing electrical gates which can be opened and closed in response to the beginning and ending of a pulse of given duration, solenoid actuated members 33 through 41 may be operated at selected points on the input power waveform for the duration of the control pulse and once operated, do not remain operated and impacted against drum 43 for the remainder of the half cycle of the power waveform as is typical of silicon controlled rectifier devices heretofore used.

As illustrated in FIG. 3, the striking force control 65 may be adjusted to shift the position of the gate control pulses with respect to the alternating waveform to have electrical gates 23 through 31 closed at variable points in time on the alternating power waveform to control the electromagnetic force imparted to the impact member and the striking force against the opposing surface of drum 43. Operation at the peak of the waveform at point "H" produces a hard impact; at point "M", a medium impact; and at point "S", a soft impact, the force being related to the magnitude of voltage at these respective points in time.

The block diagram elements of FIGS. 1 and 5 are well known to electrical, electronic and mechanical designers. For example, gates 19, 13, 23 through 31 and 69 may be of the semi-conductor type well known to electronic designers of analogue and digital circuits and of which an example is presented in FIG. 7. Motor drive 53 may be a synchronous motor which rotates in synchronism with the input alternating power source. Gear train 51 may be an arrangement of intermeshing gears of selected ratios coupled to the shaft of the synchronous motor to obtain the desired speed of rotation required to operate geneva mechanism 45. Drum position adjust 59 may be a clutch connected to gear train 51 whereby one gear may be disengaged and moved with respect to another to provide a rotational adjustment of the gears for positioning the geneva mechanism 45 and drum 43 connected thereto in a desired relationship with respect to solenoid actuated impact members 33 through 41. Clock 61 may be semi-conductor multi-state circuit such as the flip-flop variety synchronized to the input alternating power source frequency and waveform. Phase shift circuit 63 may be a resistance-capacitance combination located in the clock circuit in well known locations to electronic designers to adjust the point in time at which the multi-state clock circuit is synchronized to the input power waveform. Gate control pulse generator 73 may be a digital counter circuit of the type which converts a serial input to parallel output, well known to logic and digital electronic designers. Switch matrix 77 may be of the diode or semi-conductor transistor type well known to digital designers whereby pulses on one set of lines may be selectively coupled to another set of lines. Switch control 79 may be a keyboard or programmable patch board commonly used by electronic designers in data processing systems and which have such auxillary semi-conductor circuits associated therewith to electrically control switch matrix 77 to intercouple the appropriate lines connected thereto. Position indicator 75 may be a mechanical switch or electronic indicator such as used in servo-systems which is activated by the rotation of drum 43 to trigger gate control pulse generator 73 to start counting the pulses received from clock 61 and generate the output pulses on lines L1 through L*m*.

In summary, the invention described in FIG. 1 provides operation of solenoid actuated impact members in a time segment which is substantially short compared to one-half cycle of the alternating power waveform and at a point on the waveform which is adjustable to obtain a controllable striking force. By appropriately connecting the pulse and gate control lines as indicated in the tables of FIG. 4, a specific sequence of characters can be printed from a drum onto material placed on the surface of drum 43 by actuating impact members according to the table set forth.

The impact system illustrated in FIG. 5 operates by shifting the input power waveform 45° in phase through phase shift circuit 85 to provide a second alternating power waveform from which impact members may also be actuated. Although only one phase shifter is illustrated it should be noted that a multiplicity of phase shifters may be utilized to obtain a multiplicity of alternating power waveforms shifted in time in respect to one another. Phase shift circuit 85 may be of the well known phase shift type consisting of inductive and capacitive components or may be of the electronic type well known to electronic designers. The output $\phi 2$ of phase shift circuit 85 and $\phi 1$ of line 81 are alternately connected to buss 91 through power gates 89 and 87 alternately opened and closed by bi-stable flip-flop 111. Flip-flop 111 is actuated by pulse generator 107 which produces a sequence of pulses in synchronism with the input power waveform. As shown in FIG. 6, eight pulses are generated during one complete cycle of the input power waveform. Every time one of these pulses occurs, flip-flop 111 changes state such that in one state gate 89 is opened to connect line 81 and $\phi 1$ to buss 91 and in the other state gate 87 is opened and gate 89 closed to connect $\phi 2$ and disconnect $\phi 1$ to buss 91.

Referring to FIG. 6, pulse P1 occurs at the point in time when gate 89 is opened to connect waveform $\phi 1$ at its 45° phase point to buss 91. When pulse P2 occurs 2.08 milliseconds later (for a 60 Hertz power frequency), gate 87 is opened to connect the 45° point of waveform $\phi 2$ to buss 91. When pulse P3 occurs, gate 89 is again opened to connect buss 91 to waveform $\phi 1$ at its 135° point and at the occurrence of pulse P4, gate 87 is opened and connects waveform $\phi 2$ at its 135° point to buss 91. Pulse P5 occurs at the time gate 89 is opened to connect buss 91 to waveform $\phi 1$ at its 225° point and, when pulse P6 occurs, gate 87 connects waveform $\phi 2$ at its 225° point to buss 91. And finally, at the occurrence of P7, waveform $\phi 1$ is connected at its 315° point in phase to buss 91 and when pulse P8 occurs, waveform $\phi 2$ is connected at its 315° point to buss 91. Since waveforms $\phi 1$ and $\phi 2$ are shifted in phase with respect to one another by 45°, the voltage of the waveforms at the points of occurrence of each one of these pulses is approximately 110 volts for 156 volt peak waveform. Consequently, as illustrated in FIG. 6, every 2.08 milliseconds a voltage of 110 volts of either plus or minus polarity is gated to line buss 91. If gates 93 through 101 are selectively operated at this same time, coincident with the operation of gates 87 and 89 and at the same point in time coincident with the pulses P1 through P8, 110 volts is sequentially and selectively connected to electromagnetic actuated pins 103 to impact selected pins against opposing surface 105.

Since there are a multiplicity of operations for each cycle of the waveform of input alternating power, the actuation of gates 93 through 101 must be of very short duration as illustrated by the short duration of pulses P*n* illustrated in FIG. 6. Typical time duration of these pulses and of the associated opening of the gates controlling electromagnetic actuated pins 103 is 100 to 600 microseconds.

It should be noted that by using a multiplicity of phase shifters, a higher speed of operation may be obtained over one cycle of the input power waveform than is illustrated in FIG. 6. For example, if the phase shift of 22½° were utilized and two additional phase shifts circuits were employed, it would be possible to again double the frequency of pulses P*n* and corresponding operations of the electromagnetic actuated pins during one cycle of the alternating power waveform.

Character selection and programming circuit 113, which may be a keyboard or program patch board similar to switch control 79 of FIG. 1, actuates switch matrix control 109, to connect the pulses P*n* to the appropriate gate control line C1 through C*n*. Switch matrix control 109 may be of the same diode switching circuit or transistor switching circuit similar to that used in switch matrix 77 of FIG. 1.

In operation, linear motion drive 115 moves electromagnetic actuated pins 103 over the opposing or impact surface 105. A position sync line connected to characters selection and programming circuit 113 synchronizes the character selected by character selection and programming circuit 113 with the desired location on impact or opposing surface 105. Character selection and programming circuit 113 generates a sequence of control information to actuate switch matrix control 109 as linear motion drive 115 moves electromagnetic actuated pins 103 over surface 105 to impact a desired sequence of dot patterns on surface 105. For example, as illustrated in FIG. 5, if the letter "E" is desired to be printed, as linear motion drive 115 moves from left to right to start the printing process, the entire column of electromagneitic actuated pins 103 would be operated to form the vertical segment of the letter "E". As the linear motion drive 115 moves the pins further to the right, 2.08 milliseconds later the top and bottom and middle pins are actuated to begin forming the horizontal segments of the letter "E". This operation continues until the letter is completed, a dot being formed every 2.08 milliseconds as linear motion drive 115 moves the pins over impact surface 105. Linear motion drive 115 may be a motor and gear train combination or a drive mechanism similar to that of a typewriter. The magnetic actuated pins move across surface 105 and then return to the initial starting point after the entire line scan has been completed.

It is important to note that the system of FIG. 5 cannot be adjusted to control impact force since the specific operating points in time on the waveforms of the alternating power sources are selected to obtain the desired frequency of operation of pins 103 as they move over impact surface 105.

It should be understood that the controllable striking force provided by the impact system of FIG. 1 is extremely useful in printing magnetic ink for magnetic ink character recognition (MICR) symbols widely used in the banking field and in printing multiple thicknesses of material. By adjusting strike force control 65, various printing forces may be obtained such that thin single sheets will not be punctured and multiple sheets and MICR characters will be printed with a strong impact or striking force.

The electronic switch illustrated in FIG. 7 is operated by applying a gate control pulse to the terminal designated as C*n*. The pulse is coupled through transformer 127 into the base-emitter circuit of transistors 117 and 119. The pulse polarity is selected such that the voltage across secondary 125 is plus to minus from the base of transistor 119 to the base of transistor 117. Therefore, when a pulse appears on the primary and is coupled through the secondary, the base-emitter junctions of transistors 119 and 117 are forward biased to render the transistors conductive. Since the transistors are complementary npn and pnp transistors connected in parallel, the gate is bilateral and conducts equally well in both directions.

It should be noted that complete gate circuit is not included in FIG. 7 and that the circuitry illustrated therein is for the purposes of demonstrating a typical circuit configuration which may be utilized for the gates shown in the block diagrams of FIGS. 1 and 5.

It now should be apparent that the present invention provides a circuit arrangement which may be employed in conjunction with electromagnetically actuated impact devices such as impact printers for controlling the operation of the electromagnetic actuated members and the forces imparted thereto by selecting and controlling the time at which the electromagnetic actuated members are connected to an alternating source of power and the duration of such a connection.

Although particular components, etc., have been discussed in connection with a specific embodiment of an electromagnetic impact device constructed in accordance with the teachings of the present invention, others may be utilized. Furthermore, it will be understood that although an exemplary embodiment of the present invention has been disclosed and discussed other applications and circuit arrangements are possible in that the embodiments disclosed may be subject to various changes, modifications and substitutions without necessarily departing from the spirit of the invention.

What is claimed is:

1. An impact device comprising:

at least one striking member adapted to be electromagnetically actuated to impact against an opposing surface;

an opposing surface juxtaposed said striking member for receiving said impact from said striking member, said opposing surface being adapted to receive thereon material to be impacted by said striking member;

electromagnetic means coupled to said striking member for actuating said striking member to impact said opposing surface and the material thereon;

an electrical gate connected to said electromagnetic means adapted to be connected to a source of alternating power, said electrical gate having a control electrode adapted to be connected through a switching circuit to a source of gate control pulses having a given pulse time duration, said electrical gate being rendered conductive when opened by the presence of and for the given time duration of a gate control pulse and rendered non-conductive when closed by the absence by a gate control pulse to connect and disconnect the source of alternating power to said electromagnetic means in response to the gate control pulses whereby said striking member is impacted against said opposing surface for the given time duration of the gate control pulse and released therefrom at all other times;

a switching circuit connected to said electrical gate and adapted to be connected to the source of gate control pulses, said switching circuit having a switch control modular for selecting the gate control pulses to be connected to said electrical gate from the source of gate control pulses; and a source of gate control pulses connected to said switching circuit and adapted to be connected to the source of alternating power for generating gate control pulses of a given pulse width time duration in synchronism with the source of alternating power to actuate and open said electrical gate during said given pulse width time duration and at given points in time along the alternating power waveform.

2. The impact device described in claim 1 wherein said source of gate control pulses further includes a variable phase shift circuit to shift the time relationship between said gate control pulses of given time duration and the waveform of the source of alternating power whereby at least one striking member may be actuated at variable points in time on the waveform of the source of alternating power to control the impact force of said striking member against said opposing surface.

3. The impact device described in claim 1 wherein said electrical gate and said source of gate control pulses are adapted to be connected to 110 volt/60 and 50 Hertz power as the source of alternating power.

4. The impact device described in claim 1 further including means for inhibiting the connecting of the source of alternating power to said electrical gate when the voltage at said given points in time along the voltage waveform of the alternating power decreases below a given voltage mangitude.

5. A line impact printer comprising:

a movable surface having embossed characters thereon adapted to receive thereover material to be printed;

a plurality of electromagnetically actuated hammers aligned in a row adjacent said movable surface and to strike said movable surface and the material thereon when actuated;

a plurality of electrical gates of which each gate is exclusively connected to one of said plurality of electromagnetically actuated hammers, each of said electrical gates being adapted to be connected to switching means from which electrical pulses of a given time duration are operated to actuate each of said plurality of electrical gates to connect and disconnect a source of alternating voltage and current to each of said plurality of electromagnetically actuated hammers when each of said gates are opened and closed, respectively;

driving means connected to said movable surface for driving said movable surface synchronously with the source of alternating voltage and current to align a selected one of said embossed characters thereon opposite a specified one of said plurality of electromagnetically actuated hammers and to stop said movable surface for the time duration during which said specified one of said plurality of electromagnetically actuated hammers is actuated;

switching means connected to said plurality of electrical gates and adapted to be connected to the source of alternating voltage and current for generating and selective connecting electrical pulses of a given pulse width time duration to said electrical gates to open said electrical gates for said pulse width time duration and close said electrical gates at all other times in synchronism with the source of alternating voltage and current; and selecting means connected to said switching means for selecting which of said plurality of electrical gates is to be opened by said electrical pulses thereby selectively actuating said specified one of said plurality of electromagnetically actuated hammers to strike said selected one of said embossed characters.

6. The line impact printer described in claim 5 further including a phase shift circuit connected to said switching means for shifting the time relationship between said electrical pulses of given time duration and the source of alternating voltage and current to control the points in time on the voltage and current waveform of the source of alternating voltage and current at which said plurality of said electromagnetically actuated hammers are connected to the source of alternating voltage and current thereby controlling the striking force of said plurality of electromagnetically actuated hammers.

7. A line impact printer described in claim 5 further including means for adjusting said driving means and the time during which said movable surface is stopped to be coincident with the variable time interval over which said electrical pulses are shifted by said phase shift circuit.

8. The line impact printer disclosed in claim 5 wherein said movable surface is a cylindrical drum and said driving means comprises:

a geneva mechanism attached to said cylindrical drum to convert a source of continuous rotary motion to stepped rotary motion;

a synchronous motor adapted to be connected to the source of alternating voltage and current;

a gear train connected to said synchronous motor and said geneva mechanism whereby said continuous motion of said synchronous motor is coupled to said geneva mechanism; and means for indicating the position of said cylindrical drum to synchronize said electrical pulses with the stepped rotation of said cylindrical drum.

9. The line impact printer described in claim 5 wherein said movable surface is a train of individual surfaces, each of said surfaces having at least one character embossed thereon.

10. A continuous motion impact printer comprising:

a plurality of solenoid actuated pins positioned adjacent one another in a desired matrix configuration to form a character set, each of said plurality solenoid actuated pins being adapted to be actuated to impact against an opposing surface;

an opposing surface juxtaposed said plurality of solenoid actuated pins for receiving said impact of each of said plurality of solenoid actuated pins, said opposing surface being adapted to receive thereon material to be impacted by each of said plurality of solenoid actuated pins;

a plurality of electrical gates of which each is exclusively connected to one of said plurality of solenoid actuated pins, each of said electrical gates being adapted to connect and disconnect the source of alternating voltage and current to said one of said plurality of solenoid actuated pins to actuate said one of said plurality of solenoid actuated pins which each of said electrical gates is opened and closed, respectively;

a driving mechanism connected to said character set of solenoid actuated pins to move said character set across said opposing surface, said driving mechanism having a position indicating output which is adapted to be connected to selecting means;

phase shift means adapted to be connected to a source of alternating voltage and current and having at least two outputs of alternating voltage and current which are shifted in time and phase with respect to one another;

at least two electrical power gates, each of which is exclusively connected between one of said of at least two outputs of said phase shift means and all of said plurality of electrical gates, each of said at least two electrical power gates being responsive to electrical gate pulses to serially connect each of said phase shift means outputs one at a time to said plurality of electrical gates in response to the electrical gate pulses;

switching means connected to said plurality of electrical gates and adapted to be connected to the source of alternating voltage and current for generating and selectively connecting and disconnecting electrical control pulses to said electrical gates to selectively open and close said plurality of electrical gates in synchronism with the phase shifted outputs of said phase shift means, said switching means being connected to said at least two electrical power gates and generating electrical gate pulses to said at least two electrical power gates to serially open each of said at least of two electrical power gates in synchronism with the phase shifted outputs of said phase shift means; and selecting means connected to said switching means and said position indicating output of said driving mechanism for selecting which of said plurality of electrical gates are to be opened by said electrical control pulses thereby selectively actuating said plurality of solenoid actuated pins to impact against said opposing surface as said character set is moved across said opposing surface by said driving mechanism, said position indicating output synchronizing the actuation of said plurality of solenoid actuated pins with the motion of said driving mechanism and said character set.

11. The continuous motion impact printer described in claim 10 wherein said phase shift means has two outputs shifted in phase by 45° and wherein said phase shift means is adapted to be connected to a source of alternating voltage and current of 110 volts/60 and 50 Hertz and wherein said electrical control pulses and said electrical power gate pulses are synchronized with the alternating voltage and current to connect selected ones of said plurality of solenoid actuated pins alternately to said outputs of said phase shift means at substantially the 45°, 135°, 225° and 315° points in time, respectively, on each of the phase shift means outputs, whereby solenoid actuated pins may be impacted against said opposing surface substantially every 2.08 millisecond as said character set moves thereover.

* * * * *